US012559207B2

(12) United States Patent
Armstrong

(10) Patent No.: US 12,559,207 B2
(45) Date of Patent: Feb. 24, 2026

(54) OFFSET WAKE SURF TOW SYSTEM AND METHOD

(71) Applicant: Boris Armstrong, Columbia, SC (US)

(72) Inventor: Boris Armstrong, Columbia, SC (US)

( * ) Notice: Subject to any disclaimer, the term of this patent is extended or adjusted under 35 U.S.C. 154(b) by 632 days.

(21) Appl. No.: 18/076,535

(22) Filed: Dec. 7, 2022

(65) Prior Publication Data

US 2023/0094095 A1 Mar. 30, 2023

Related U.S. Application Data

(63) Continuation-in-part of application No. 17/246,710, filed on May 2, 2021, now abandoned.

(51) Int. Cl.
*B63B 34/67* (2020.01)
*B63B 34/63* (2020.01)

(52) U.S. Cl.
CPC ..... *B63B 34/67* (2020.02); *B63B 34/63* (2020.02)

(58) Field of Classification Search
CPC ..... B63B 34/00; B63B 34/60; B63B 34/63; B63B 34/67; B63B 34/70
USPC ..... 114/242, 249, 253
See application file for complete search history.

(56) References Cited

U.S. PATENT DOCUMENTS 3,041,996 A 7/1962 Roberts
3,092,068 A 6/1963 Brownson
3,930,460 A * 1/1976 Beck ..... B63B 34/63 441/69
4,280,240 A * 7/1981 Neuscheler ..... B63B 34/63 114/253
4,371,352 A * 2/1983 Holland ..... B63B 34/63 264/279.1
4,863,407 A * 9/1989 Casad ..... B63B 34/63 441/69
4,867,722 A * 9/1989 Joseph ..... B63B 34/63 16/421
5,341,758 A 8/1994 Strickland
5,680,677 A * 10/1997 Lovell ..... B63B 34/63 16/436
5,732,648 A * 3/1998 Aragon ..... B63B 34/67 242/904
5,943,977 A * 8/1999 Womack ..... B63B 34/67 441/69
6,860,774 B2 3/2005 Lintzner
D682,968 S 5/2013 Adinolfe, Sr.
(Continued)

*Primary Examiner* — Daniel V Venne
(74) *Attorney, Agent, or Firm* — Kirk A. Wilson; Joseph T. Guy; Patent Filing Specialist Inc.

(57) ABSTRACT

An offset wake surf tow system designed to enhance the experience of wakesurfing behind watercraft. It consists of ropes and hardware assembled into attachment, adjustment, and grasping sections. The tow system is designed to stay in the water while riders are surfing and attaches to the watercraft, offset to the side of the rider, so that the rider may elect to grasp or drop the tow system multiple times without interference or entanglement. The offset and vertical attachment of the tow system, length adjustment, and interaction with the watercraft wake combine to achieve the desired lateral and vertical positioning of the system to remain close enough for the rider to reach, and, out of the rider's way when not in use. The tow system also provides a line to grasp for the surfer to start from still in the water and, due to the offset attachment, assists with rider pick-up.

8 Claims, 11 Drawing Sheets

(56) References Cited

U.S. PATENT DOCUMENTS

| | | | |
|---|---|---|---|
| D888,618 | S | 6/2020 | Pang |
| D901,337 | S | 11/2020 | Pang |
| D946,684 | S | 3/2022 | Luo |

* cited by examiner

OFFSET WAKE SURF TOW SYSTEM AND METHOD

CROSS-REFERENCE TO RELATED APPLICATIONS

The present invention is a continuation-in-part of U.S. patent application Ser. No. 17/246,710, titled "Wake Surf Tow System", filed May 2, 2021, incorporated herein by reference in its entirety, now abandoned.

BACKGROUND OF THE INVENTION

The present invention relates to watersports tow lines used to pull a water-skier, wakeboarder, wakesurfer, kayaker, etc., behind a watercraft designed or modified for the listed activities. Specifically, this invention focuses on the current evolution of the sport of wakesurfing, where the watercraft tow vehicle travels ten to twelve miles per hour and is able to produce a wake of sufficient size and shape to generate enough energy to propel a rider on a surfboard, hydrofoil board, kayak or other devices without the rider having to grasp the tow line continuously.

Watercraft of this type, referred to as "Wakeboard" or "Wakesurf" boats, have a vertical superstructure attached, referred to as a "wakeboard tower" (310, 410, 620). At the top, center of the tower, there is a pylon, rope attachment point (350, 420) for wakeboard ropes, wakesurf ropes, or other types of tow lines (910). The primary objective of wakesurfing is to ride continuously without holding onto the tow line (910) using just the energy of the wake. When the watercraft is under way, the area of the wake that provides enough energy or "push" to allow the rider to surf without holding onto a tow line (910) is commonly referred to as the "pocket" (670, 960). The front of the pocket is very close to the stern of the watercraft, beginning approximately seven to ten feet behind the transom (330). The length of the pocket varies with watercraft design, speed, weight, and many other conditions and can range in length from a couple of feet to several feet long.

The current convention for wakesurfing as it relates to tow line (910) designs demonstrated by FIG. 9 is ropes twenty to twenty-five feet long with a small handle (940), or "T", attached at the end. These ropes are connected to the boat tower at the standard, center pylon attachment point (460). By design, they tow the rider (360) in or near the pocket (670, 960) and must be thrown into the boat, retrieved by a boat passenger if dropped by the rider (360), or thrown to the other side of the wake when not needed by the rider (360). So, when a conventional surf rope is not in use by the rider (360), it is either in the boat or out of reach on the opposite side of the wake. Due to the mounting position at the center pylon of the boat tower and length, if not tossed into the boat, retrieved by a passenger, or thrown to the other side of the wake, the current surf rope design gravitates towards the rider (360) and impedes the ability to surf by bouncing around and under the rider (360, 950, 1130) creating a potentially unsafe condition. It is very common for the rider (360, 950, 1130) to lose momentum, drift aft of the pocket (670, 960), then sink into the water, ending that particular ride. Once a rider (360, 950, 1130) has dropped the rope or thrown it into the boat, there is no option to retrieve it during that ride. Even if a passenger has enough skill to toss the rope to the rider (360, 950, 1130), conventional surf ropes are too short to reach a rider (360, 950, 1130) at the back of the pocket.

Current surf rope designs also pose a significant threat of injury due to rider (360, 950, 1130) entanglement. The common practice of looping or bunching up the rope to toss it into the back of the boat, or throw it to the other side of the wake, creates situations where a rider (360, 950, 1130) that falls while attempting to toss the rope could have an appendage caught by one of the loops or the rope handle itself. Based on their position along the length of the rope, the handle (940), knots, or bulges (930) incorporated into the tow line (910) can injure a rider's hands as the rope slides through their grasp, or, when the rider falls on the rope with the boat under way, the above attributes increase injury potential as the boat continues pulling the rope under the fallen rider.

Lastly, when the rider falls after successfully riding without the rope, which was tossed in the boat or retrieved by a passenger, the boat returns to pick the rider up. When the rider attempts to surf again, a passenger or the boat operator must hand the rope to the rider. Due to the central attachment point of the conventional surf rope, it naturally falls in line behind the boat, in the propeller wash or slip stream. This effect makes it more difficult for a downed rider to reach the conventional surf rope left in the water as the boat returns to the rider for another attempt (1120).

BRIEF SUMMARY OF THE INVENTION

A wake surf offset tow system is disclosed as having a watercraft with a tower superstructure extending laterally across the watercraft, the tower mounted to at least one gunwale. The tower has a pylon positioned near a watercraft centerline and at least one offset projection positioned laterally from the watercraft centerline and aligned proximate the at least one gunwale. A tow line is removably coupled to the tower, the tow line having an attachment section removably engaged with the least one offset projection before extending further aft, an adjustment section removably engaged with the attachment section, and a grasping section removably engaged with the adjustment section, said grasping section having a consistent circumference and effectively linear outer surface on a flexibly solid core.

Also disclosed is a wake surf tow line having an attachment section, an adjustment section removably engaged with the attachment section, and a grasping section removably engaged with the adjustment section, said grasping section having a consistent circumference and effectively linear outer surface on a flexibly solid core.

Also disclosed is a method for towing a wake surf rider having the steps of: obtaining a tow line having an attachment section, an adjustment section, and a grasping section; adjusting the adjustment section to specific tow conditions; deploying the tow line from a watercraft having a tower, the tow line removably coupled to an elevated offset projection on a rider's preferred side, thereby minimizing tow line interaction with the wake before extending further aft; advancing the watercraft to position the tow line such that the rider can grasp and release at any point along the length of the grasping section; continually advancing the watercraft such that the tow line naturally interacts with a watercraft wake, thereby positioning the grasping section within reach of the rider while allowing room to maneuver when not actively being held by the rider; and grasping and releasing the grasping section multiple times by the rider while surfing, thereby optimizing the rider's position in a pocket.

BRIEF DESCRIPTION OF THE DRAWINGS

The accompanying drawings, which are included to provide a further understanding of the invention and are incorporated in and constitute part of this specification, illustrate embodiments of the invention and the description server to explain the principles of the invention.

DETAILED DESCRIPTION

Figure 1:
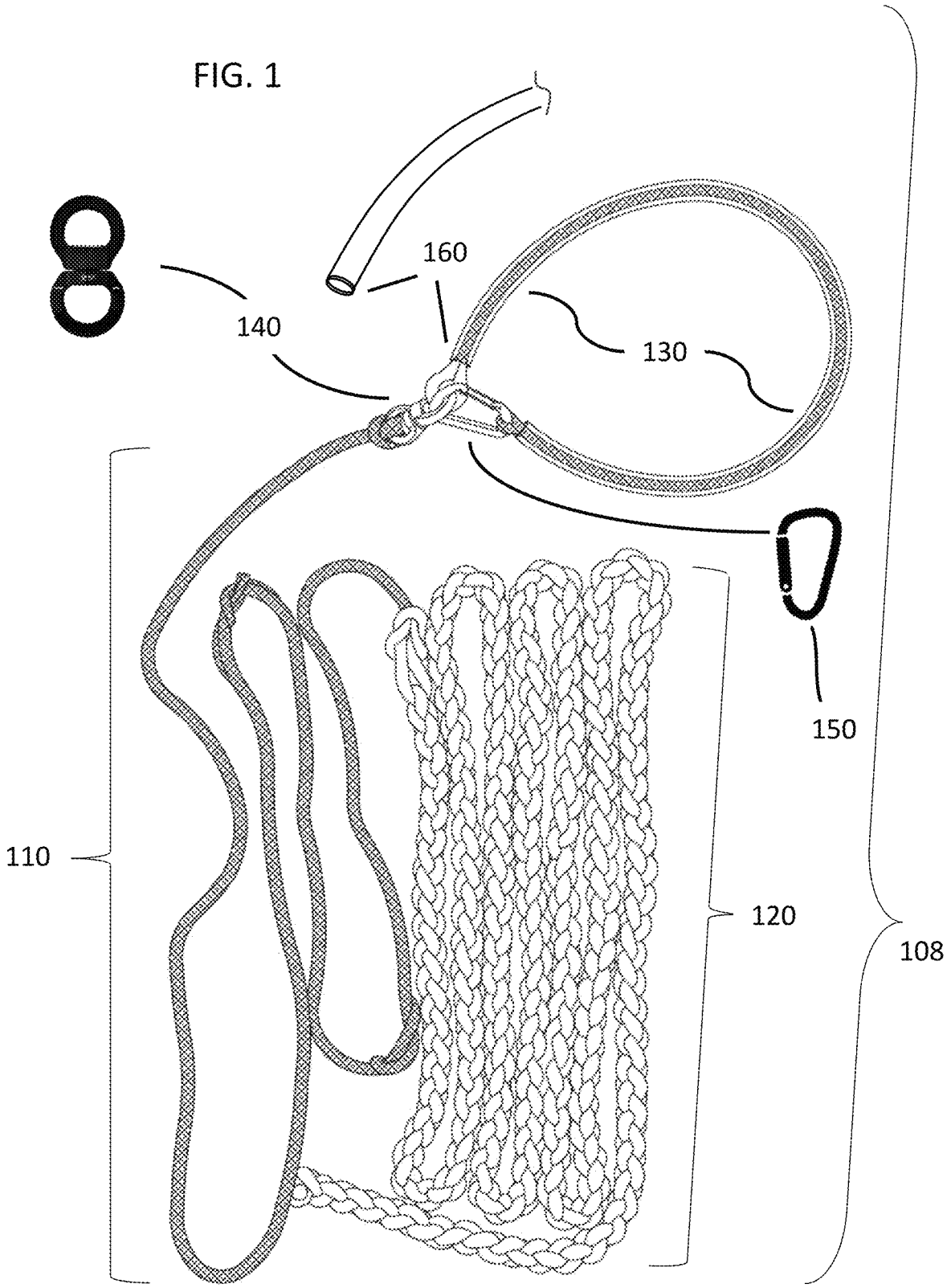
FIG. 1 illustrates the Wake Surf Tow System (WSTS) primary embodiment and key elements.

Some embodiments of the present invention are described in this section in detail sufficient for one skilled in the art to practice the present invention without undue experimentation. It is to be understood, however, that the fact that a limited number of preferred embodiments are described does not in any way limit the scope of the present invention as set forth in the claims.

It is to be understood that whenever a range of values is described herein, i.e. whether in this section or any other part of this patent document, the range includes the end points and every point there between as if each and every such point had been expressly described. Unless otherwise stated, the words "about" and "substantially" as used herein are to be construed as meaning the normal measuring and/or fabrication limitations related to the value or condition which the word "about" or "substantially" modifies. Unless expressly stated otherwise, the term "embodiment" is used herein to mean an embodiment of the present invention. Unless expressly stated otherwise, the terms "rope" and "line" can be used interchangeably.

Component descriptions may have multiple component numbers for various embodiments of the invention:

| Component Number | Description |
|---|---|
| 108, 910 | Tow Line |
| 120, 210, 270, 340, 650 | Grasping Section |
| 130, 220, 250 | Attachment Section |
| 140 | Swivel |
| 150 | Carabiner |
| 160, 230 | Protective Sleeve |
| 240, 280 | Grasping Loop |
| 212 | Grasping Section Outer Surface |
| 110, 260, 640 | Adjustment Section |
| 310, 410, 620 | Wakeboard Tower |
| 320, 430 | Wakeboard Tower Side |
| 330 | Transom |
| 350, 420, 920 | Pylon |
| 360, 950, 1130 | Rider |
| 440, 850 | Cleat |
| 450 | Offset |
| 460 | Pylon Attachment Point |
| 470, 660 | Preferred Side |
| 510 | Offset Projection |
| 610 | Forward Edge |
| 630 | Watercraft Centerline |
| 690 | Grasp Point |
| 670, 960 | Pocket |
| 710, 720 | Slower Tow Speed |
| 730, 740 | Faster Tow Speed |
| 810 | Fore-transom |
| 820 | Aft-transom |
| 830 | Shortened Length |
| 840 | Extended Length |
| 930 | Bulges |
| 940 | Handle |
| 1010 | Loops |
| 1020 | 4-strand Seesaw |
| 1030 | Loop |
| 1040 | Flat Braid |
| 1050 | 'T' Handle |
| 1060 | Larger Knot |
| 1110 | Closer Path |
| 1120 | Conventional Path |

The present disclosure advances the sport of wakesurfing or similar activity in a novel way by addressing limitations of current tow line (910) designs and offers a system customized to each watercraft, size, structure, wake generation, and speed. It improves flexibility, safety, and efficiency resulting in more time spent riding, less time picking up riders that have faltered, and a hands-free approach for those other than the rider.

The Offset Wake Surf Tow System (WSTS) provides attachment and adjustment options to accommodate a wide variety of watercraft. It interacts with the specific wake generated by the watercraft to provide optimum placement for the rider (360, 950, 1130) to grasp and release as needed an unlimited number of times while surfing. The attachment, adjustment, and wake interaction attributes of WSTS assist in all phases of wakesurfing; from the time the rider (360, 950, 1130) uses the WSTS to start from still in the water, hold the WSTS during the ride, or, releases the WSTS to surf unassisted. These attributes are also helpful in the return to pick up a fallen rider (360, 950, 1130) for another attempt.

The WSTS stays in the water, towed by the watercraft, anytime riders are actively surfing or preparing to surf. It is only removed at the conclusion of the activity or, moved to change sides for a rider (360, 950, 1130) that prefers to surf on the opposite side of the watercraft and, otherwise, requires no assistance from passengers or the driver. While surfing, WSTS naturally interacts with the wake to rest in a location within reach of the rider (360, 950, 1130) if needed while allowing room to maneuver if not actively being held.

Key elements of system performance begin with the attachment method which provides a measure of the necessary offset (450) of the WSTS; to the rider's side opposite of the wake. To achieve this offset (450), the WSTS is attached to the preferred side (470, 660) of the wakeboard tower side (320, 430). This can be effectively accomplished by attaching the WSTS directly to the top corner of the tower side (320, 430) at an offset projection (510), or if using the center pylon attachment point (460), ensuring the WSTS is routed through the tower structure such that the WSTS exits the tower on the left or right top corner on the same preferred side (470, 660) the surfer rides. Alternatively, the WSTS can be attached to another sturdy mount location, such as a cleat (440, 850) on the gunwale, provided it is sufficiently offset. The cleat (440, 850) attachment option will significantly reduce the elevation of the WSTS as it is towed behind the boat and require the rider (360, 950, 1130) to reach lower to pick it up.

Figure 6:
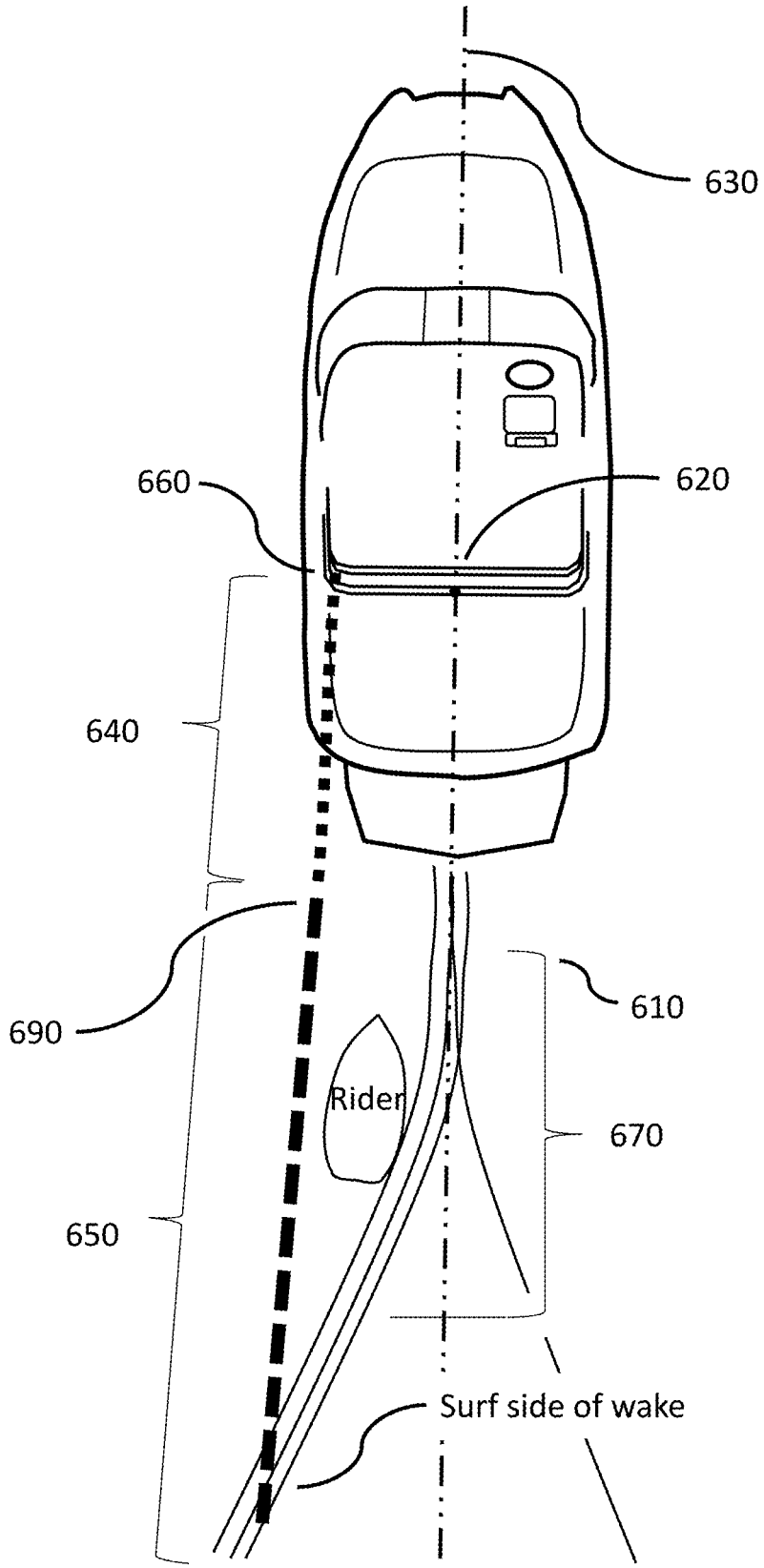
FIG. 6 illustrates the top view of a watercraft towing the Wake Surf Tow System and how the system is attached to the corner of the wakeboard tower. It also depicts wake development behind the watercraft, Wake Surf Tow System interaction with the wake behind the rider, and relative lengths of the attachment and grasping sections of the system.

The WSTS overall length is adjusted to account for the length of the watercraft tow vehicle, its specific tower placement and design, and the watercraft surf speed. When under way, the wake behind the watercraft forms in the center of the watercraft's centerline (630), splits into two sections, and each section curves outward away from the boat's centerline as the watercraft moves forward. The WSTS is designed to contact the surf side of the wake (340, FIG. 6) so that the wake effectively pushes the tow line (710, 730) away from the watercraft centerline (630). Two factors combine to influence this effect: 1) Watercraft speed and, 2) WSTS adjustment length.

Figure 7:
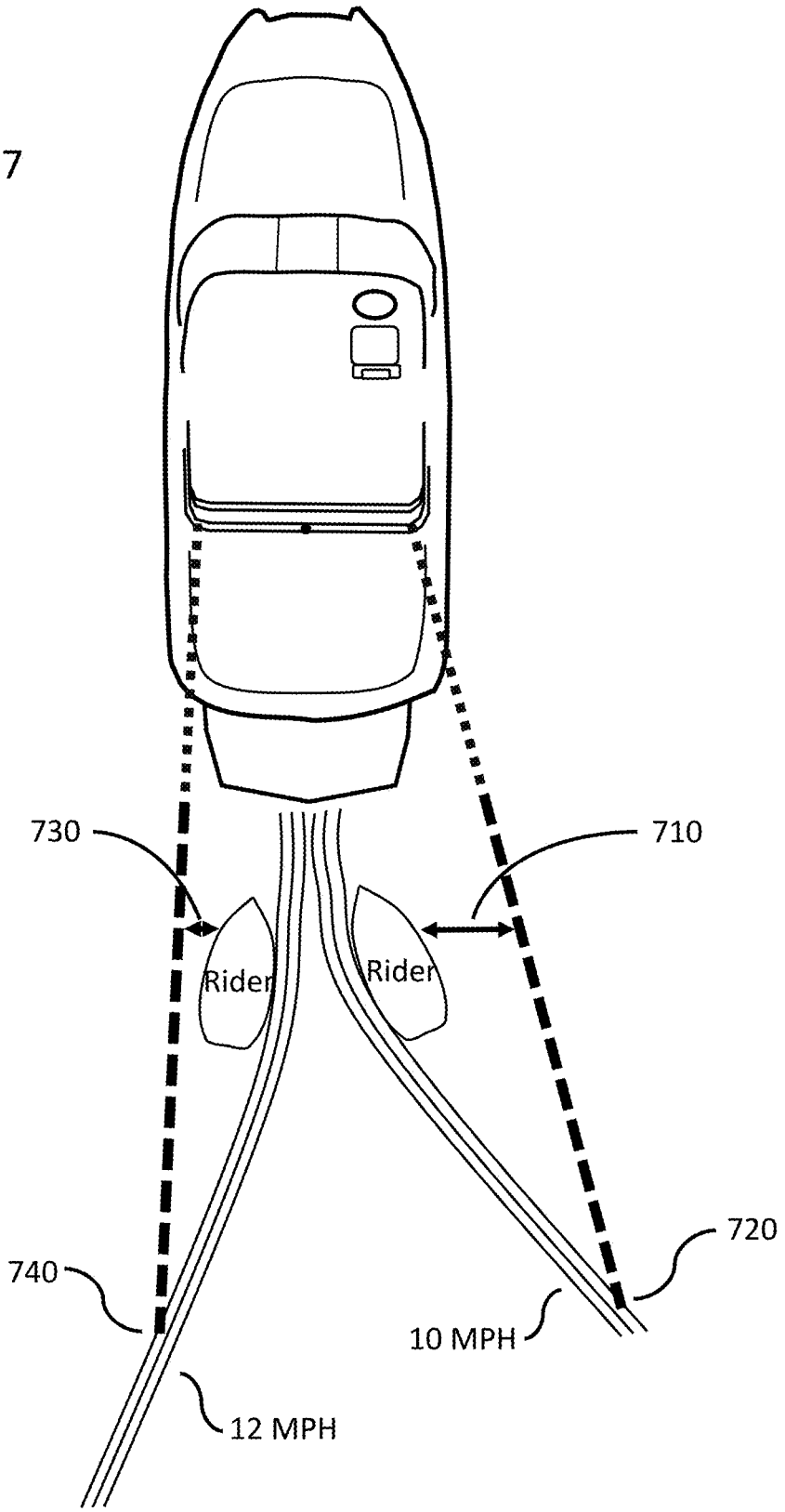
FIG. 7 demonstrates the effect of watercraft speed on wake development and Wake Surf Tow System adjustment considerations based on surf speed. It also demonstrates how WSTS interaction with the wake "pushes" the WSTS away from the watercraft longitudinal axis, away from the rider and more parallel with the "pocket."

FIG. 7 demonstrates the effect of watercraft speed on the shape of the wake and how it affects the position of the WSTS from the rider (360, 950, 1130) for a given system length. Slower tow speed (710, 720) results in a wake that appears to turn out from the longitudinal axis more sharply, closer to the watercraft, with the WSTS resting farther from the rider. A faster tow speed (730, 740) results in a wake that appears more elongated and turns out less sharply, resulting in the grasping section resting closer to the rider. In both cases, the wake is moving outward at a constant speed; the watercraft speed creates the effect.

Figure 8:
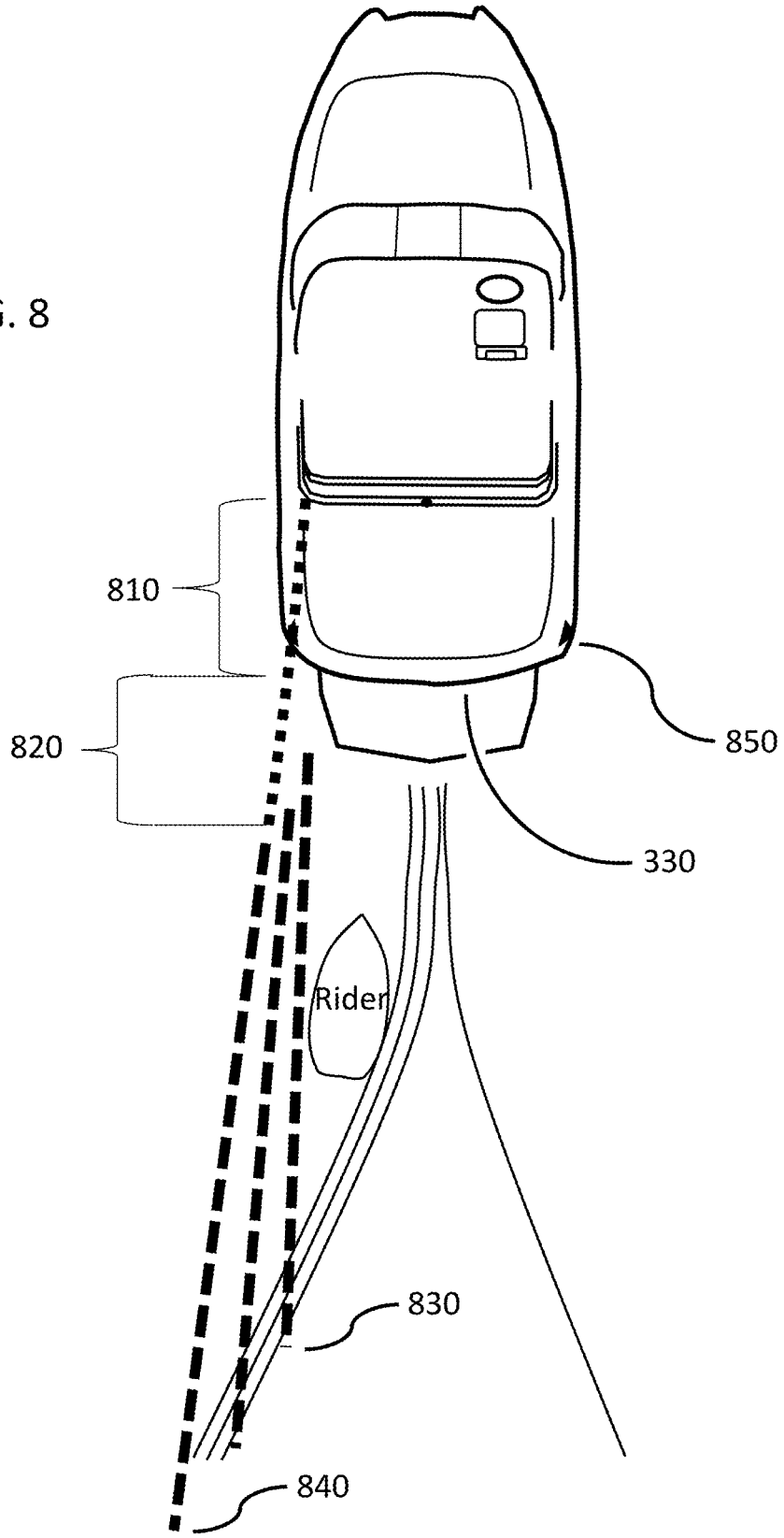
FIG. 8 illustrates how Wake Surf Tow System adjustment is used for optimum placement from the rider. It also shows how the system accounts for the watercraft size and design characteristics as well as surf speed.
Figure 9:
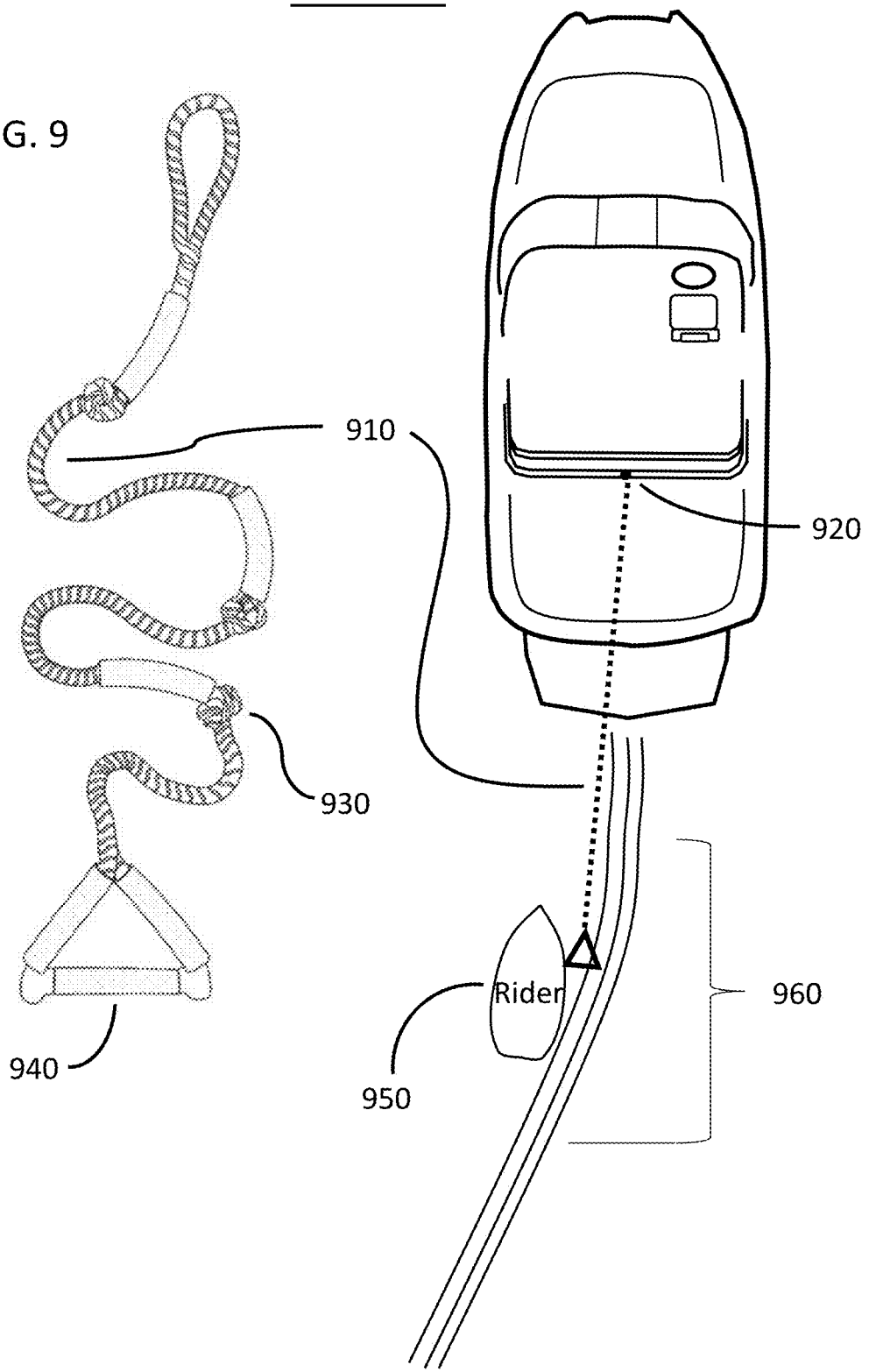
Prior Art FIG. 9
FIG. 9 depicts prior art characteristics and interaction with a rider established in the "pocket".
Figure 10:
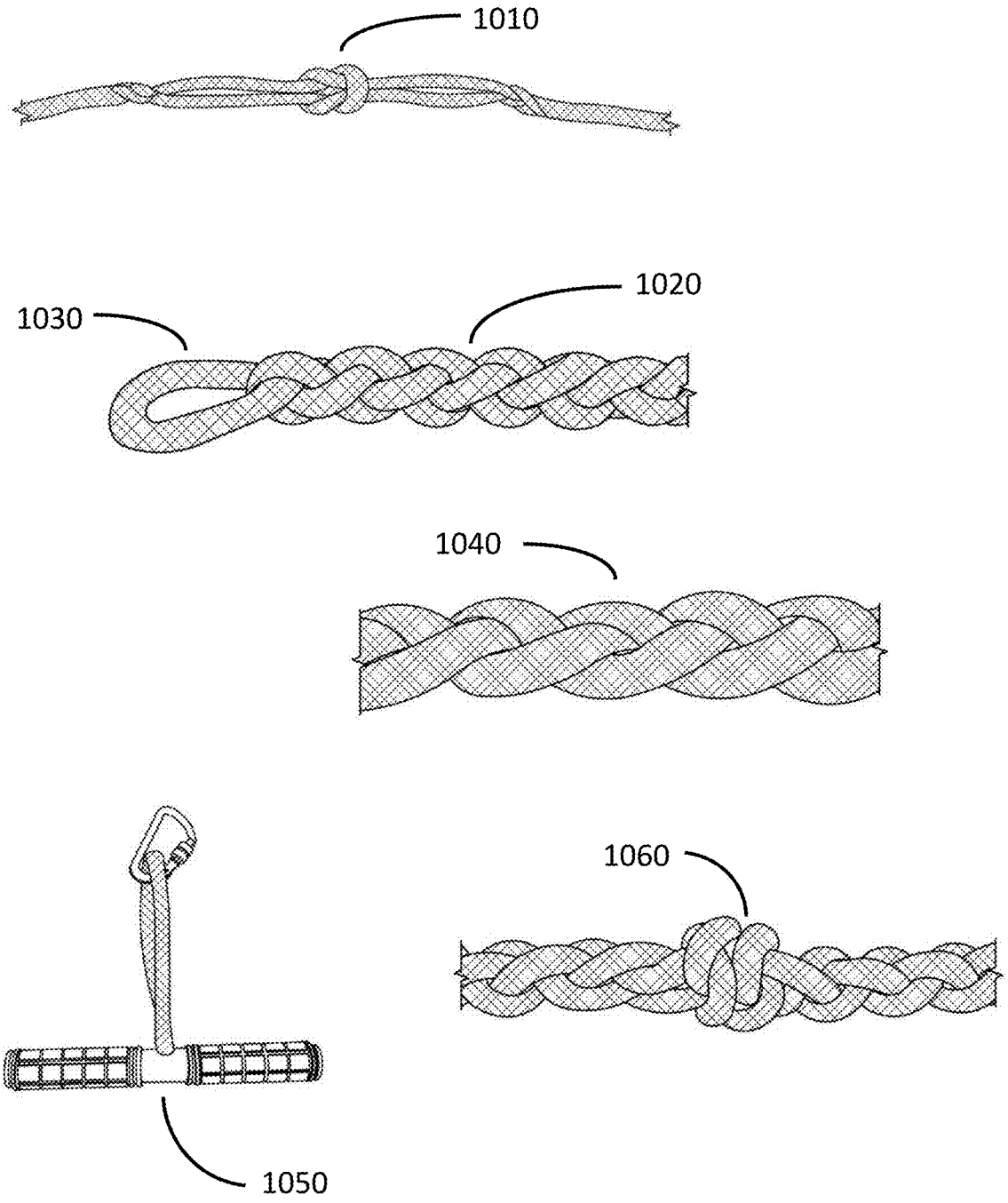
FIG. 10 illustrates attributes and potential variations of the Wake Surf Tow System. The adjustment section (110, 260, 640) is illustrated with a fore-transom adjustment (1070) and an aft-transom adjustment (1080).

FIG. 8 demonstrates the differences in WSTS adjustment length once the desired surf speed is established. As the system length approaches extended length (840), the grasping section contacts the wake farther aft, more offset from the boat path, and farther from the rider. As the system approaches shortened length (830), the grasping section rests closer to the rider's side. The adjustment section (110, 260, 640) of the Wake Surf Tow System is used to set an appropriate rope length to provide adequate space for a surfer to ride without rope interference while remaining close enough for the rider to grasp if necessary.

Figure 11:
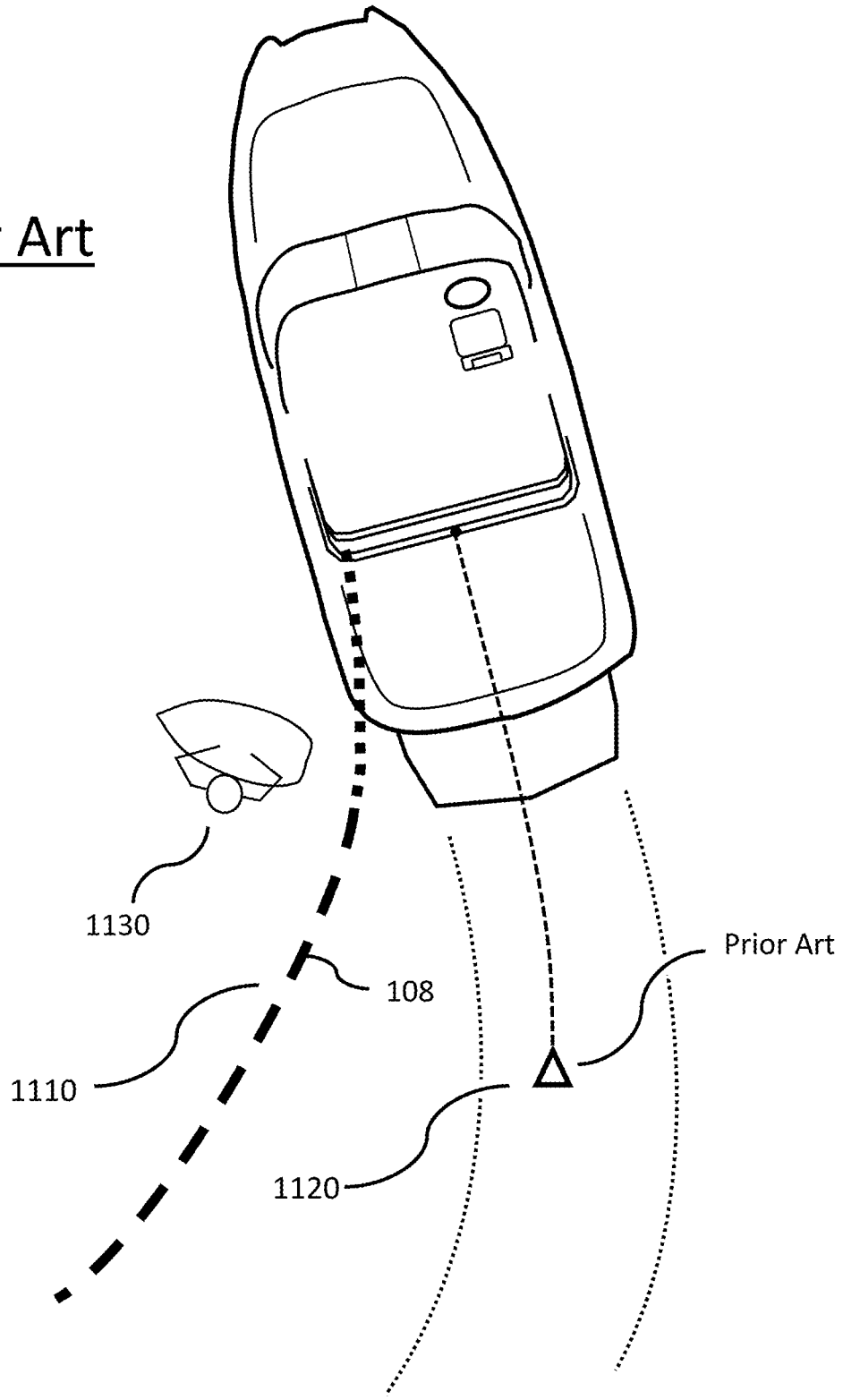
FIG. 11 Prior Art
FIG. 11 depicts a watercraft returning to pick up a downed rider for another surf attempt and demonstrates the difference between the Wake Surf Tow System and prior art as it relates to ease of access for the rider.

When a rider falls, the WSTS simplifies and expedites the next surf attempt, as seen in FIG. 11. The WSTS stays in the water towed by the watercraft, so no passenger or driver assistance is needed to handle the tow line (910). The driver returns to the location of the fallen rider and passes next to the rider on the preferred surf side (470, 660), which is the preferred side of the boat that the WSTS is offset to. As the boat returns to the downed rider, the offset (450) of the tow line (108), due to the attachment method, makes the rope closer path (1110) more accessible to the downed rider than the conventional surf rope trailing from the center pylon on the tower at the conventional path (1120). Experienced driver/rider combinations can execute a pickup and return to surfing without bringing the boat to a stop. The WSTS construction and design provides other advantages: naturally buoyant, easy to see, extremely low risk of rider entanglement, low risk of abrasion to the rider, and very low risk of boat propeller entanglement.

The WSTS provides a watersports tow line (108) tailored to individual watercraft, structure, and speed, and is designed to give a rider the option to grasp and release the tow system multiple times in a continuous riding or surfing session. WSTS provides a plurality of grasping locations assisting a rider in moving forward and aft to find the optimum surfing location on the watercraft wake. If not held by the rider, the WSTS naturally rests in a position not to interfere with the rider but within reach if needed, and by design, offers a range of area to reacquire the tow system that is greater the area that the rider can surf—greater than the size of the "pocket." Two characteristics of the WSTS combine to elevate the tow line (108), minimizing the amount the rider needs to reach down to grasp the system. First, the elevation provided by the attachment location on the wakeboard tower side (320) delays WSTS contact with the water as the system extends aft from the watercraft. Second, drag is created on the WSTS from the last several feet of the grasping section (340) contacting the watercraft wake, providing tension and further elevating the system. The WSTS is adaptable in length to accommodate individual watercraft designs and chosen surf speeds. In the primary embodiment, the WSTS is constructed to accommodate watercraft from twenty to twenty-six feet in length and traveling at speeds of ten to twelve miles per hour. WSTS is comprised of three primary segments; 1) Attachment, 2) Adjustment, and 3) Grasping. The transom (330) of the watercraft is a standard reference point and will be used for discussing the WSTS attributes relative to the watercraft and WSTS total length.

The WSTS attachment section (130, 250, 220) is constructed of rope, nylon webbing, or other strong, flexible material with attributes incorporated and hardware necessary to adapt and connect to a variety of watercraft and tower applications, protect the rope from abrasion, and protect the finish of watercraft tower or structure. In the primary embodiment, the attachment method engages or connects to an offset projection (510) of the watercraft tower and results in the WSTS extending aft from the upper corner of the wakeboard tower on the preferred side (470, 660) of the rider. In this embodiment, the attachment section (130, 250) is half-inch, hollow-braid polypropylene rope approximately three feet in length, covered in clear vinyl tubing (160), attached directly to one side of a swivel (140) and closed with a carabiner (150), to the same side of the swivel, to create a loop. The vinyl tubing protects the rope and the watercraft tower finish from damage or wear. The optional swivel is used as the connection point for each end of the attachment section (130, 250). The three-foot-length of the attachment section (130, 250) provides flexibility to attach to most, if not all, current wakeboard towers (310, 410). If it is desired to connect to the central pylon attachment point (460) of the tower (410), the attachment section (220), is routed through the tower structure in such a way that it exits to the preferred side (470) of the rider. In this case, a protective sleeve (230) is able to move along the length of the attachment section (220) where needed for structural protection at the offset projection (510). In other embodiments, the attachment section (130, 250) is permanently or semi-permanently connected to the tower using straps and/or hardware wherein this attribute is installed on both sides of the tower to efficiently switch sides of the WSTS (430).

The WSTS adjustment section (110, 260, 640) is constructed of rope, nylon webbing, or other strong, flexible material with attributes incorporated and hardware necessary to adapt the length of the WSTS to many watercraft and/or tower applications. FIG. 8 shows where the WSTS adjustment section (110, 260, 640) combines two considerations into one adjustment; fore-transom adjustment (810) and aft-transom adjustment (820). For the fore-transom adjustment (810), proper adjustment of the WSTS accounts for the length of the watercraft along with the wakeboard tower design and placement on the watercraft. For the aft-transom adjustment (820), the primary variable determining length adjustment is the speed of the watercraft while surfing. In the primary embodiment, the WSTS is designed to accommodate watercraft up to twenty-six feet long, and an adjustment section (110, 260, 640) of approximately seventeen feet is comprised of a plurality of removable portions (260) of half-inch hollow-braid polypropylene rope with eye splice loops (290) at each end (260, 640, 1010). The adjustment sections (110, 260, 640) are added or removed to achieve the desired overall length, which, for a watercraft speed of ten to twelve miles per hour, is approximately twenty-five to twenty-six feet beyond the transom (330). This distance includes the entire length of the grasping section (twenty-one to twenty-two feet) plus four or five feet of adjustment section (110, 260, 640). Again, the two primary factors affecting the adjustment of the WSTS are; fore-transom watercraft dimensions, which is affected by tower design and placement, and aft-transom watercraft speed when surfing. Considerations for tower design are significant enough to affect adjustment as some towers lean towards the bow, some towards the stern and some more vertical. In the primary embodiment, the ratio for changing how far the WSTS rests from the rider's side is 3:1. Every three feet in length adjustment changes where the grasping section rests from the rider's side (laterally) approximately one foot (FIG. 8).

The WSTS grasping section (120, 210, 270), is constructed of materials in the finished product having a specific gravity of less than 1.0, do not absorb water, maintains strength when wet, and are UV resistant, such as solid-braid, polypropylene rope, commonly referred to as "Derby Rope". This material or similar material must be buoyant, flexible, and non-abrasive. The profile of the grasping section (120, 270, 210) reveals a consistent circumference throughout the length of the grasping section and a effectively linear outer surface (212) with a flexibly solid core (275) throughout the useable portion. Of the total WSTS length, the grasping section (120, 210, 270) length is dictated by watercraft tow speed, economics (the grasping section is more expensive to produce), and the requirement to have an adjustment section (110, 260, 640) of sufficient length to accommodate a wide variety of watercraft. The grasping section (120, 201, 270) is intended to interact with the watercraft wake aft of a rider established in the wakesurf pocket (670, 960). This interaction with the wake provides the benefit that optimizes lateral placement relative to the rider. The wake "pushes" the WSTS to the side which provides lateral offset (710, 730) that gives the rider space to maneuver when not grasping the WSTS, and also results in the WSTS trailing at an angle from the attachment point that parallels the rider, ensuring that the system is easiest to grasp along the full range of the pocket (670, 960).

In the primary embodiment, the grasping section (650) is twenty-one to twenty-two feet long, reaching to approximately twenty-five-and one-half feet from the transom (330), accommodating a watercraft speed of ten to twelve miles per hour. It is connected to the adjustment section (110, 260, 640) via an eye splice loop (290) on the adjustment side and a grasping loop (280, 240, 1030) incorporated into the weave at the beginning of the grasping section (120, 210, 270). When properly adjusted, the grasping section (120, 210, 270, 650) begins at approximately three-and one-half feet behind the watercraft transom (330) which represents the extreme forward area where a rider would grasp the WSTS grasp point (690). Constructing the grasping section any longer would be an unnecessary expense. The circumference of the grasping section is 4½ to 5 inches allowing a wide variety of hand sizes to grasp. The grasping section circumference should be constant and free from obstructions along the length used by the rider. The construction of the grasping section is a balance between providing a flexible object easy that is easy to grip without being too abrasive or containing attributes that increase injury potential. In the primary embodiment, ½" and ⅝" solid-braid polypropylene ropes are combined and woven in a continuous four-strand seesaw knot (1020) resulting in a circumference of approximately four and one-half inches.

Figure 2:
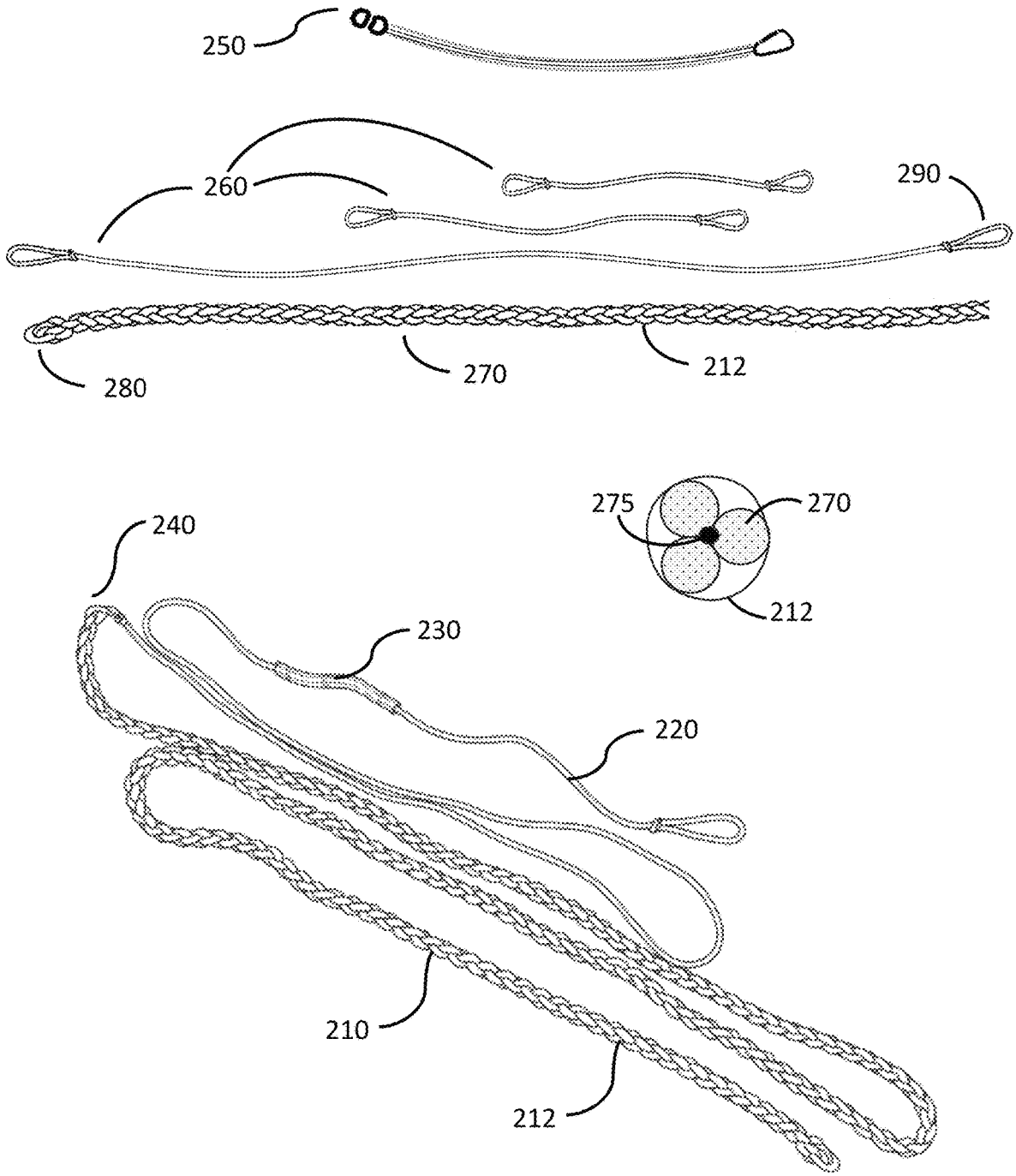
FIG. 2 illustrates details of the primary embodiment and, an alternate embodiment of the Wake Surf Tow System with a configuration designed to attach to the center pylon of the wakeboard tower.
Figure 3:
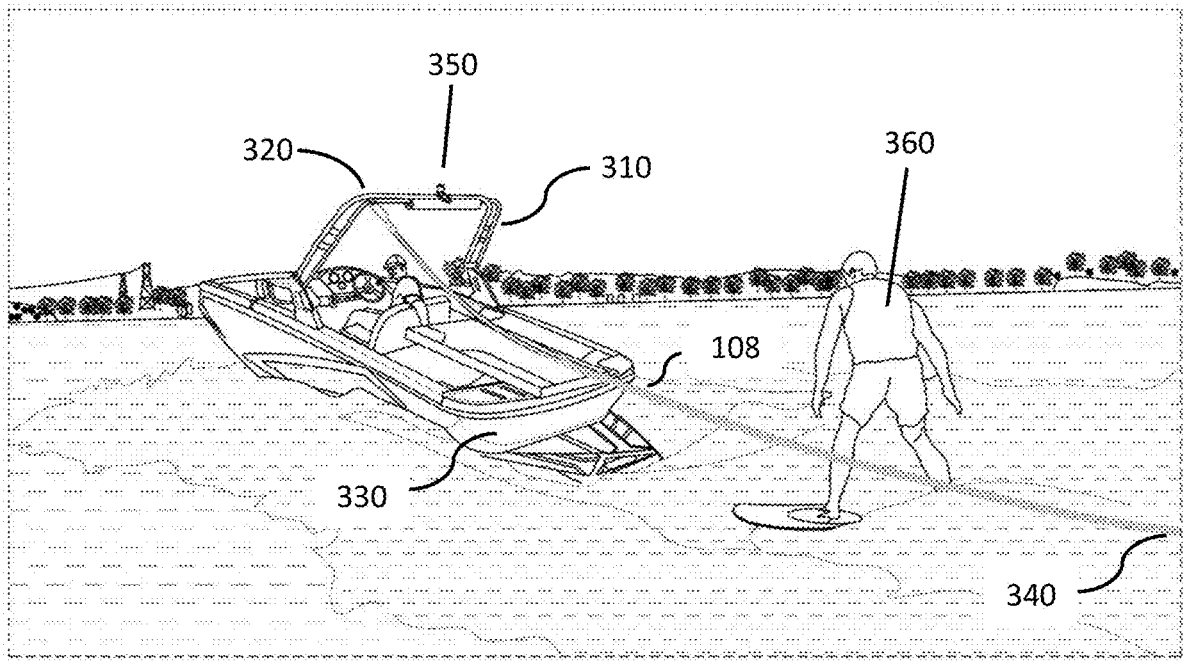
FIG. 3 Prior Art
FIG. 3 illustrates wakesurfing with the Wake Surf Tow System behind a watercraft designed for the activity, how the system is attached, the elevation provided by the attachment method, and the location to place an attribute designed to assist a rider when starting from still in the water.
Figure 4:
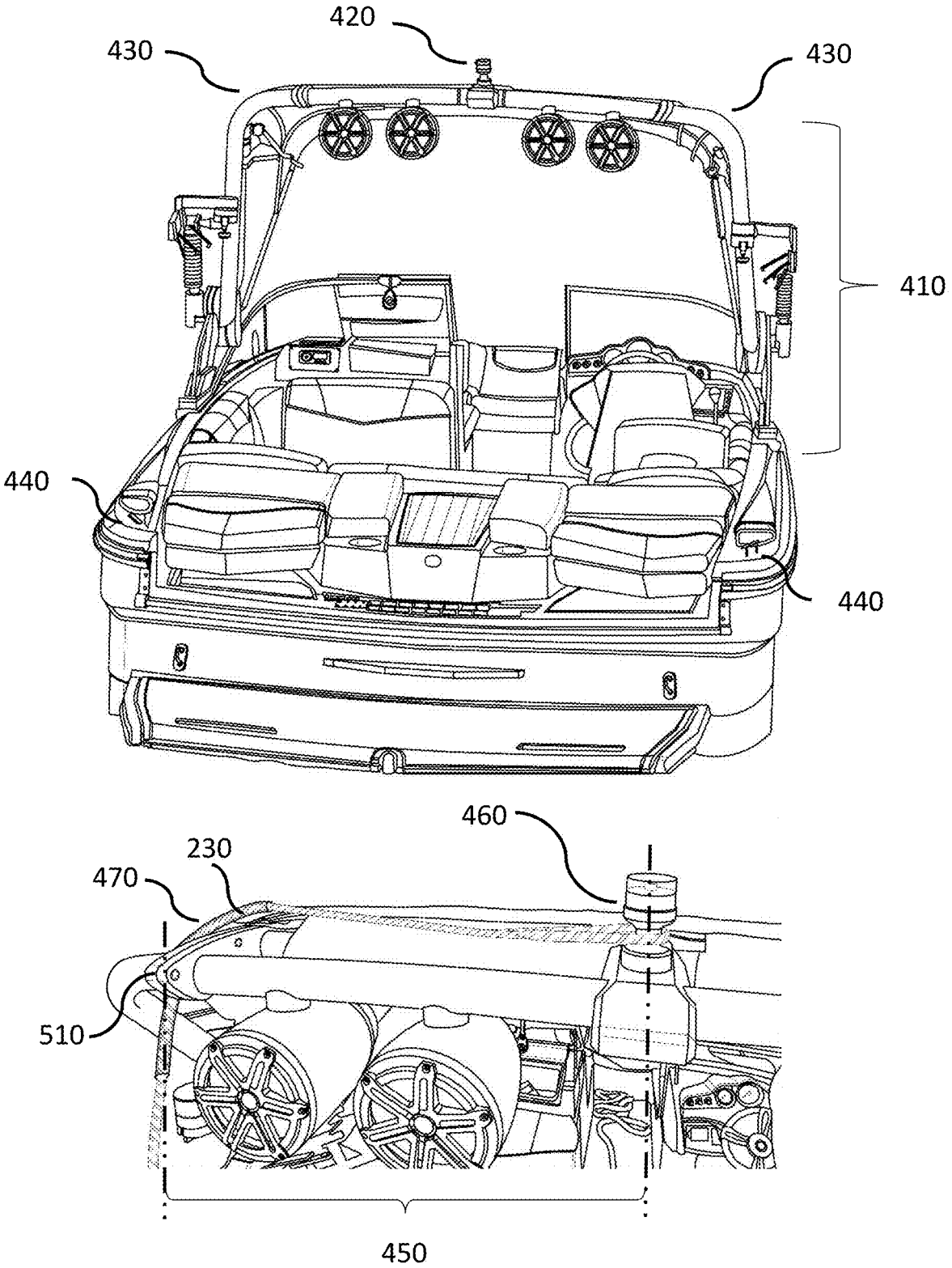
FIG. 4 Prior Art
FIG. 4 depicts typical wakeboard/wakesurf watercraft design, tower structure and rope attachment points for prior art and the Wake Surf Tow System.
Figure 5:
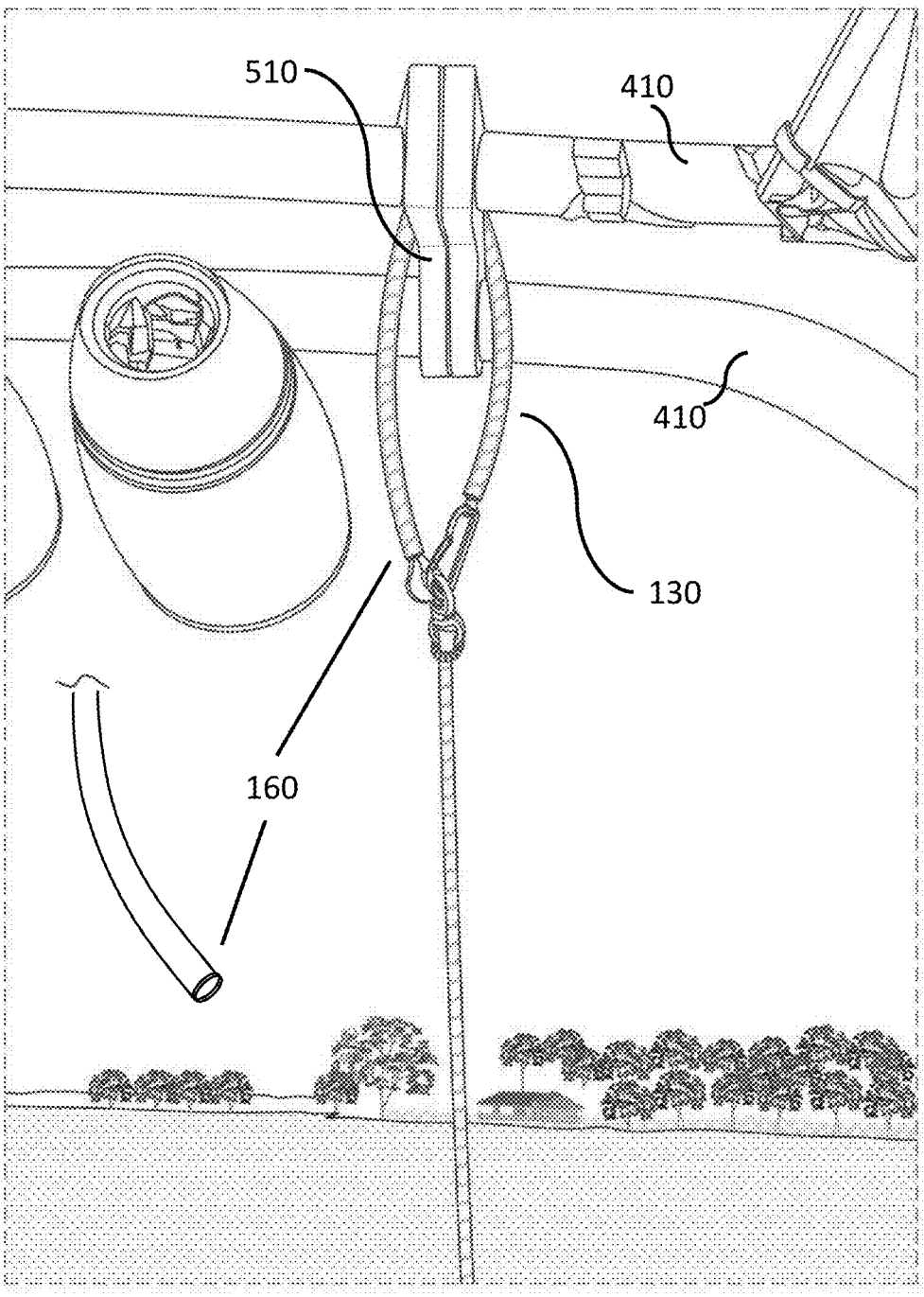
FIG. 5 illustrates the primary embodiment of the Wake Surf Tow System attachment section on a typical wakeboard tower. The viewpoint is from inside the watercraft looking aft, towards the stern.

FIG. 2 illustrates an end view of a grasping section rope embodiment having three braided strands [270], a grasping section outer surface [212], and a flexibly solid core [275]. The number of strands vary depending on the desired circumference.

In some embodiments, the WSTS, may be equipped with a single attribute that assists with a rider's grip to help with "getting up", or starting from still in the water. A small handle (940) or "T" (1050) or a single, larger knot (1060) may be incorporated into the rope weave to accomplish the same objective. This attribute is not necessary or intended to be used once the rider is successfully "up" and surfing. To avoid injury potential, if used, this attribute must only be attached at the forward edge (610) of the grasping section, approximately seven to eight feet from the watercraft transom (330). This coincides with the forward edge of the "pocket" (670, 960) and away from the area a rider could encounter the attribute during a fall. The attributes may be permanently attached or detachable for use only when an inexperienced rider with a weaker grip finds it necessary.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A wake surf offset tow system comprising:

a watercraft comprising;

a tower superstructure extending laterally across the watercraft, said tower mounted to at least one gunwale and further comprising;

a pylon positioned near a watercraft centerline, at least one offset projection positioned laterally from the watercraft centerline and aligned proximate the at least one gunwale;

a tow line removably coupled to the tower, the tow line further comprising;

an attachment section removably engaged with the least one offset projection before extending further aft, an adjustment section removably engaged with the attachment section, and a grasping section removably engaged with the adjustment section, said grasping section comprising a consistent circumference and effectively linear outer surface on a flexibly solid core.

2. The wake surf tow system of claim 1, wherein the attachment section removably engages with the pylon prior to extending an offset distance to engage with the at least one offset projection before extending further aft.

3. The wake surf tow system of claim 1, wherein the attachment section further comprises a protective sleeve covering at least a portion of the attachment section.

4. The wake surf tow system of claim 1, wherein the attachment section is permanently engaged with the tower.

5. The wake surf tow system of claim 1, wherein the adjustment section further comprises a plurality of removable portions configured to vary a length of the adjustment section to specific tow conditions.

6. The wake surf tow system of claim 5, wherein the specific tow conditions comprise a fore-transom adjustment and an aft-transom adjustment.

7. The wake surf tow system of claim 5, wherein the grasping section further comprises buoyant, flexible, and non-abrasive materials.

8. The wake surf tow system of claim 1, wherein the grasping section further comprises at least one of a knot, bulge, knob, and handle positioned at an extreme forward area.

* * * * *